US006097170A

United States Patent [19]

Larson

[11] Patent Number: 6,097,170

[45] Date of Patent: Aug. 1, 2000

[54] SIGNALING MACHINE FOR COMPUTER CONTROLLED APPLIANCE

[76] Inventor: Eric K. Larson, 42 King Philip Rd., Narragansett, R.I. 02882

[21] Appl. No.: 08/820,610

[22] Filed: Mar. 19, 1997

[51] Int. Cl.[7] ..... G05B 19/29

[52] U.S. Cl. ..... 318/603; 318/443; 318/446

[58] Field of Search ..... 68/12.01, 12.02, 68/12.16, 12.17, 12.23, 12.24; 338/215; 200/179, 11 R, 12, 21, 24, 28, 36, 40, 35 H, 61.27, 61.31, 61.46; 318/560, 567, 596, 603, 605, 254, 443, 446, 466, 1, 2

[56] References Cited

U.S. PATENT DOCUMENTS

| | | | |
|---|---|---|---|
| 3,740,975 | 6/1973 | Cornelius | 68/18 F |
| 4,336,472 | 6/1982 | Czech | 310/68 E |
| 4,346,271 | 8/1982 | Cushing | 200/38 R |
| 4,743,820 | 5/1988 | Veach | 318/578 |
| 4,986,092 | 1/1991 | Sood et al. | 68/12.01 |
| 5,150,489 | 9/1992 | Kaji et al. | 8/159 |
| 5,290,978 | 3/1994 | Georgacakis et al. | 200/38 R |
| 5,381,080 | 1/1995 | Schnell et al. | 318/566 |
| 5,689,096 | 11/1997 | Weaver et al. | 200/38 R |

*Primary Examiner*—Brian Sircus

[57] ABSTRACT

A signaling machine for a computer controlled appliance includes a pointer movable by a handle to any of several positions and a switch generating and sending to the computer an output signal when actuated. The pointer and can be moved by an operator to any of its several positions. The pointer is coupled to a motor and to a potentiometer. The motor receives signals from the computer and moves the pointer in accordance with such signals. The potentiometer generates and sends to the computer signals indicating the pointer's position.

2 Claims, 6 Drawing Sheets

SIGNALING MACHINE FOR COMPUTER CONTROLLED APPLIANCE

BRIEF SUMMARY OF THE INVENTION

The invention relates to the operation of appliances such as clothes washing machines or clothes dryers, and more particularly to a device for sending signals between an operator of an appliance and a computer controlling the operations of the appliance.

The invention features a pointer movable to any of several positions and a switch generating and sending to the computer an output signal when actuated. An operator can see the pointer and can move it to any of its several positions. The pointer is also coupled to a motor and to a potentiometer. The motor receives signals from the computer and moves the pointer in accordance with such signals. The potentiometer generates and sends to the computer signals indicating the pointer's position. The computer can thus send information to an operator by moving the pointer to a particular position, and an operator can send information to the computer by moving the pointer to some position and actuating the switch.

DETAILED DESCRIPTION

Figure 1:
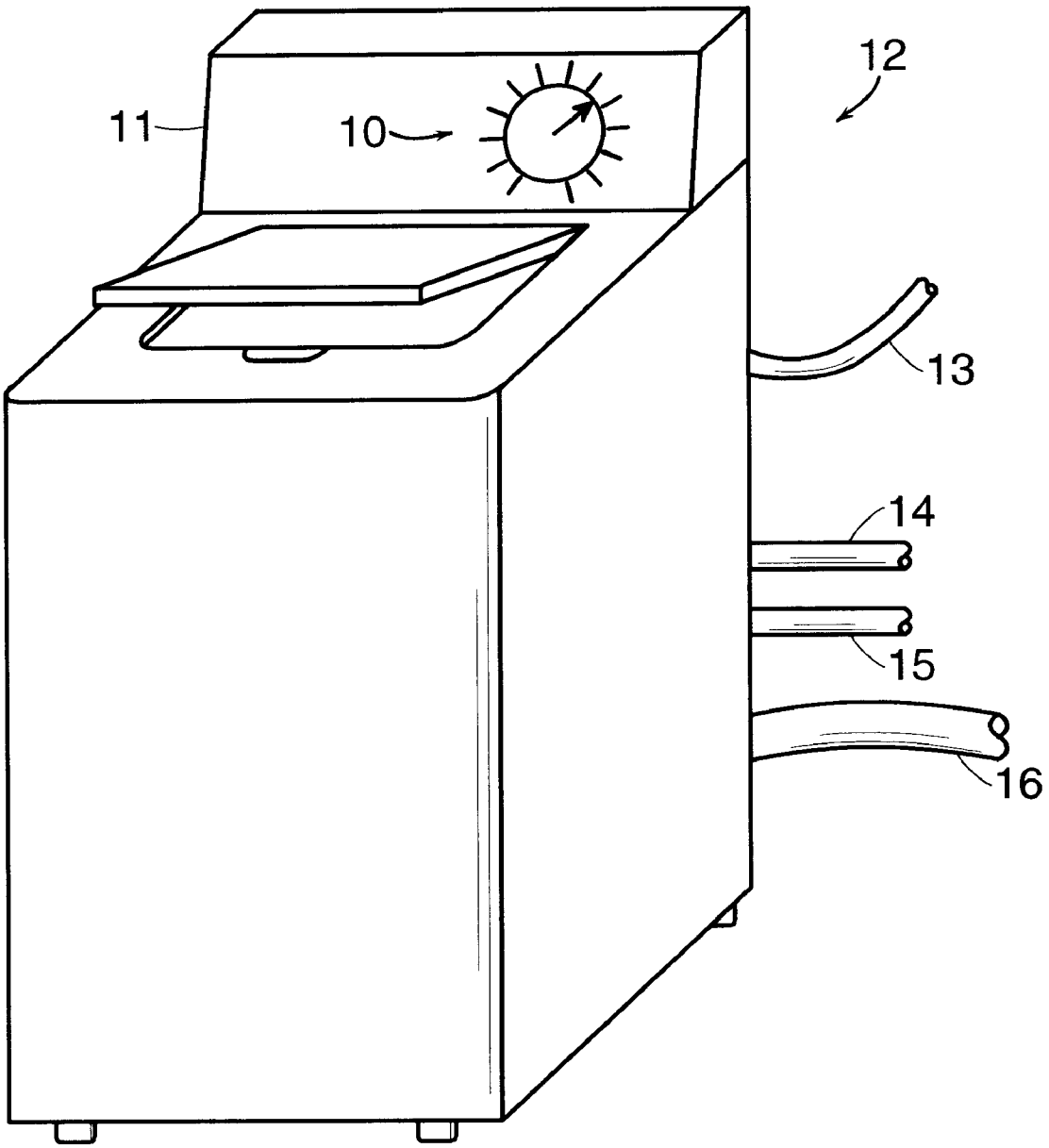
FIG. 1 shows a signaling machine according to the invention installed on he control panel of an appliance.
Figure 2:
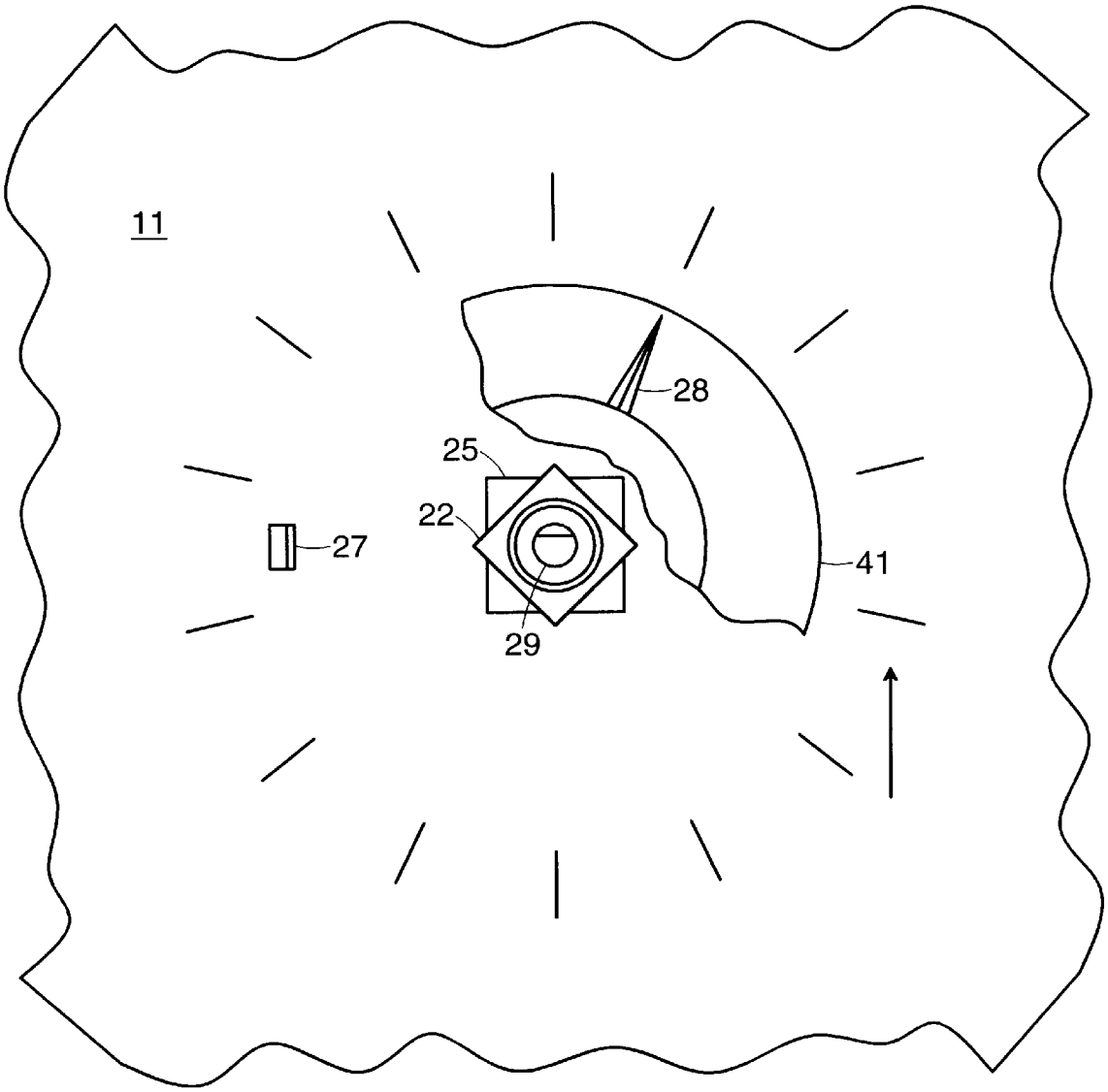
FIG. 2 shows the mounting mechanism by which the signaling machine of FIG. 1 is affixed to the control panel of the appliance of FIG. 1. Some portions have been cut away to reveal underlying structure.

Signaling machine 10 according to the invention is shown in FIG. 1 installed on control panel 11 of clothes washing machine 12, which is supplied with electric power on cable 13, with cold water on line 14, with hot water on line 15, and with drainage on line 16. The operation of washing machine 12 is controlled by computer 17 which emits operating signals 19 controlling operation of valves and motors and other components of washing machine 12. Computer 17 includes a clock 18 and stored signals 20 defining one or more sequences of operating steps which are carried out to effect a complete washing operation.

Housing 21 of signaling machine 10 is secured to panel 11 by square flange 22 on the end of neck 23, which protrudes from housing 21, and spring clip 24 extending from housing 21. Housing 21 is affixed to panel 11 by pushing from the back side of the panel flange 22 through square hole 25, then twisting the housing until locking tooth 26 of spring clip 24 snaps into locking hole 27 of panel 11. Pointer 28 with attached handle 41 is then affixed to shaft 29 of signaling machine 10. Various messages 30 appear on panel 11 adjacent to pointer 28.

Figure 3:
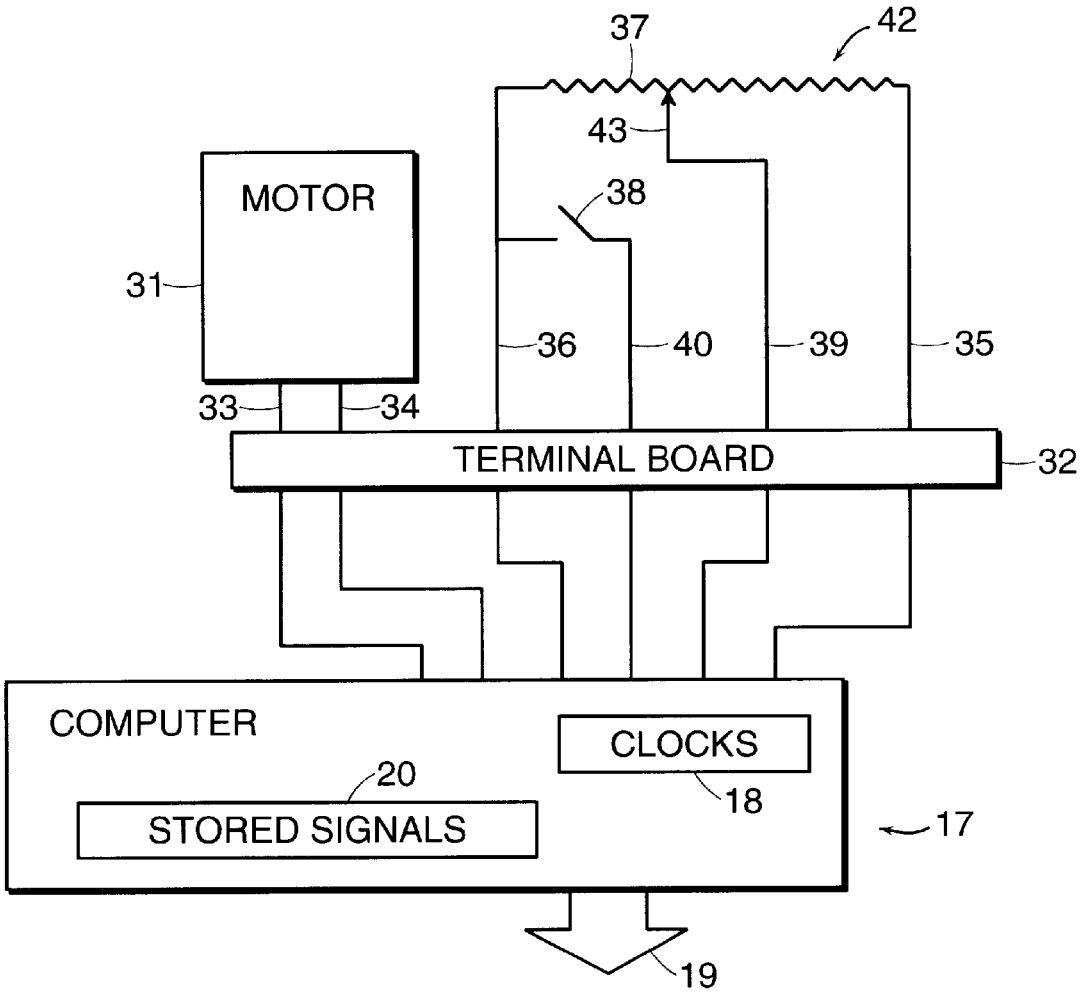
FIG. 3 shows schematically the electrical components of the appliance and signaling machine of FIG. 1 and their connections.

Electrical components of signaling machine 10 as shown particularly in FIG. 3, include motor 31 connected through leads 33 and 34 to terminal board 32 and thence to computer 17 and power leads 35 and 36 connected to terminal board 32 and thence to computer 17. Resistor 37 of potentiometer 42 is connected between power leads 35 and 36; potentiometer center contact 43 is connected by lead 39 to terminal board 32 and thence to computer 17; and switch 38 is connected to power lead 35 and by lead 40 to terminal board 32 and thence to computer 17.

Figure 4:
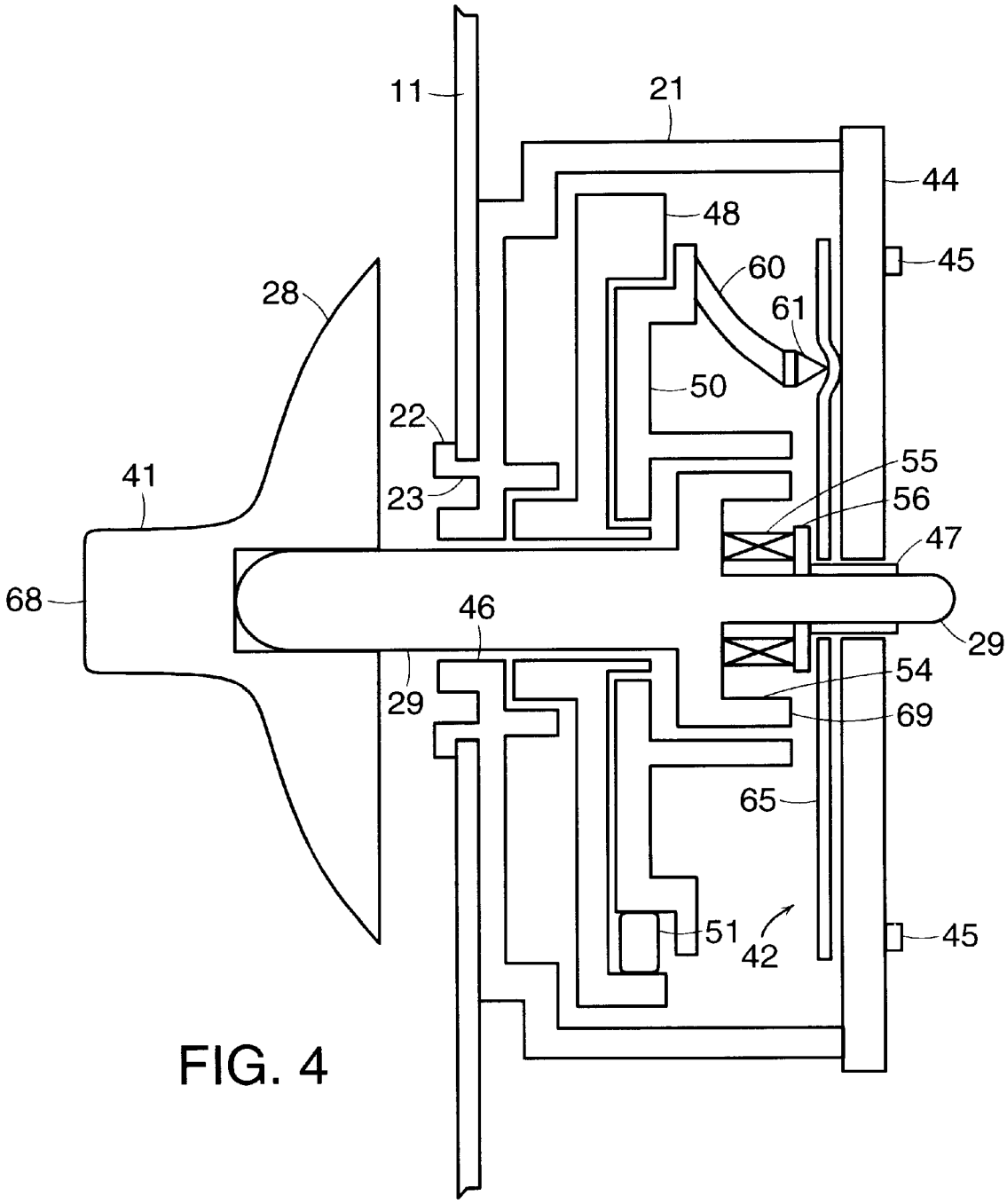
FIG. 4 shows a cross-sectional view of the signaling machine of FIG. 1
Figure 5:
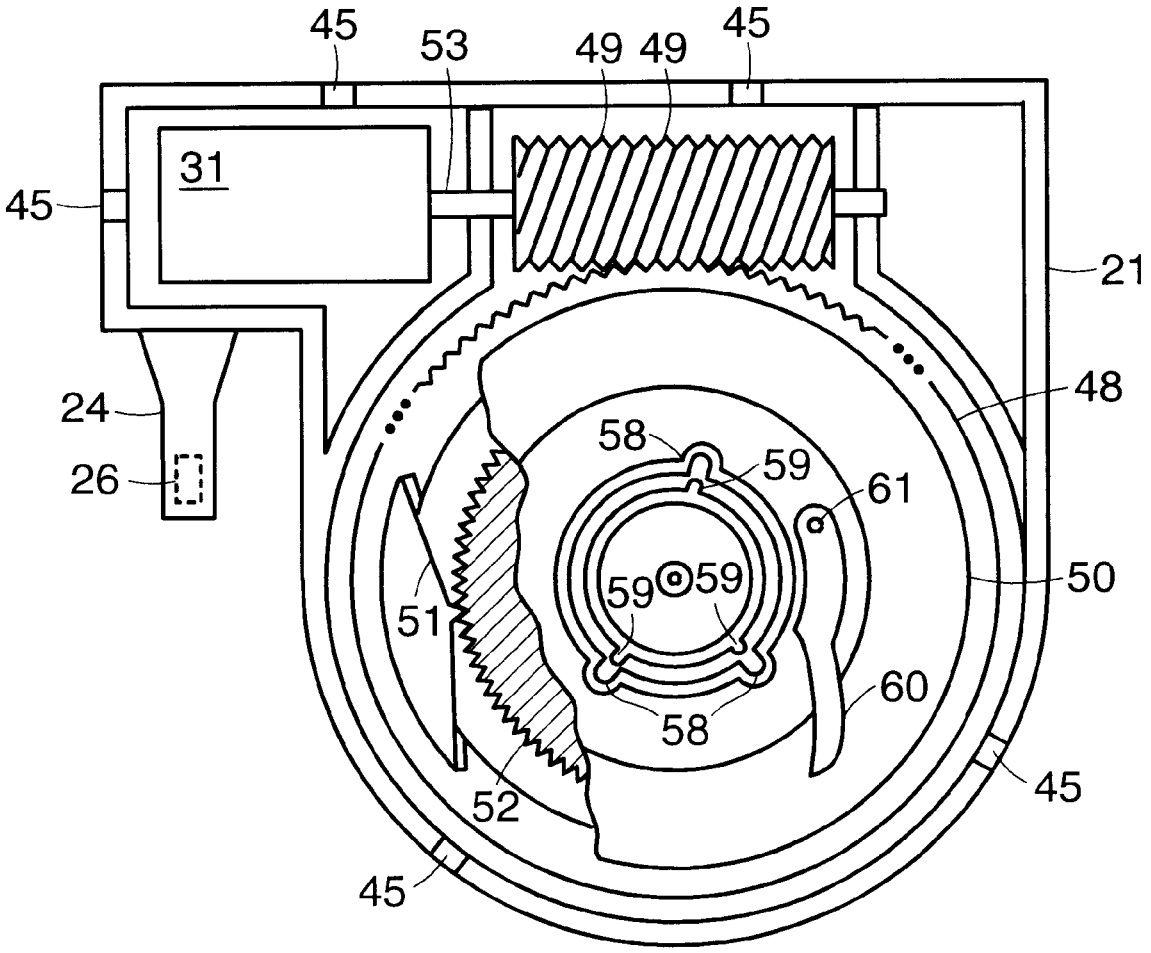
FIG. 5 shows a view from the rear of the signaling machine of FIG. 1. The back cover of the signaling machine is removed and some portions are shown cut away to reveal underlying structure.
Figure 6:
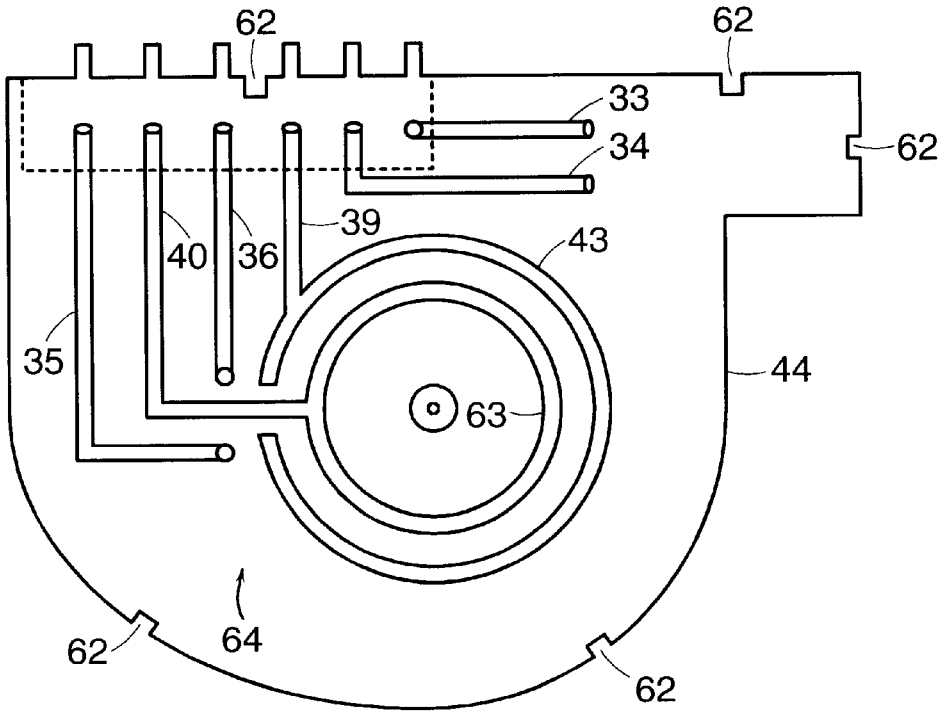
FIG. 6 shows the inside of the back cover of the signaling machine of FIG. 1 with conductive strips thereon.
Figure 7:
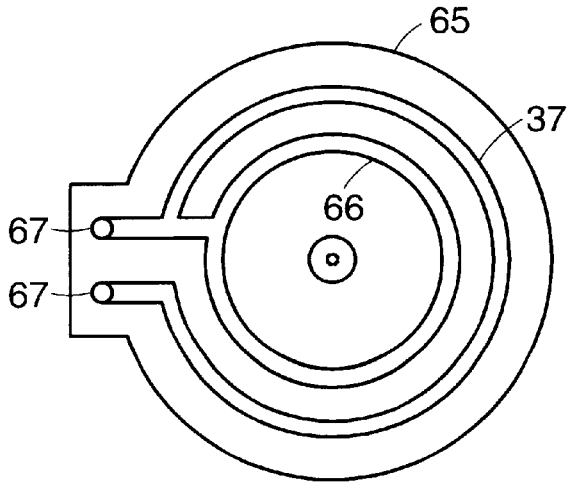
FIG. 7 shows the overlay sheet attached to the back cover shown in FIG. 6 with strips of resistive material thereon.

Referring now to FIGS. 4 and 5, back plate 44 is attached to housing 21 by snaps 45 engaging slots 62. Front bearing 48 in housing 21 and back bearing 47 on back plate 44 support shaft 29. Switch disk 54, affixed to shaft 29 extends outward and rearward from shaft 29. Spring 55 bearing on back washer 56 resting against back plate 44 presses against switch disk 54 urging shaft 29 forward (to the left as shown in FIG. 4). Gear wheel 48 is supported on shaft 29 and has teeth engaging helical Sear 49, which is coupled by shaft 53 to motor 31. Potentiometer wheel 50 is nested in a cavity of gear wheel 48 and is coupled to gear wheel by a clutch mechanism consisting of spring detent device 51 which engages toothed rim 52 of potentiometer wheel 50. Coupling cylinder 57 extends rearward from potentiometer wheel 50 and carries keyways 58 which engage keys 59 protruding radially outward from switch disk 54. The engagement of keyways 58 and keys 59 is such that shaft 29 and potentiometer wheel 50 are constrained to rotate together but may move axially relative to one another. Leaf spring 60 affixed to potentiometer wheel SO supports pressure foot 61 and biases it rearward against potentiometer 42.

Back plate 44 has deposited on its inward surface circular conductive metallic strips 64 which form potentiometer center contact 43 and switch contact 63. Other strips form leads 33, 34, 35, 36, 39, and 40. Membrane 65 made of a flexible nonconductive material has deposited on its rearward facing side circular strips of resistive material which form potentiometer resistor 37 and switch contact 66. Other strips form electrical connections to rivet points 67. Membrane 65 is riveted to back plate 44 with rivets passing through rivet points 67 and the ends of power supply leads 36 and 35 thereby supporting membrane 65 on back plate 44 and connecting electrically its electrical elements to the power supply.

The circular strips of the membrane are the same size as and directly oppose those on the back plate. The opposed circular strips are not, however, in firm contact and there is in general not a conductive electrical path between them.

Pressure foot 61 is at the same radial distance from the center of shaft 29 as potentiometer resistor 37 and where it bears against potentiometer resistor 37 it presses the resistor strip into firm contact with the underlying conductive strip to produce an electrical contact. Thus potentiometer center contact 43 is connected to potentiometer resistor 37 at a point corresponding to the angular position of pressure foot 61, which is coupled to potentiometer wheel 50 and thence to shaft 29 and pointer 20 so that the potentiometer functions as a signal generator sending the output voltage of the potentiometer to the computer as a signal indicative of the position of the pointer.

The end 68 of handle 41 provides an actuator for moving shaft 29 and switch disk 54 axially rearward causing terminal edge 69 of switch disk 54, which is at the same radial distance from shaft 29 as switch contact strips 63 and 66, to press against membrane 65. The pressure of edge 69 puts the strips 63 and 66 in electrical contact closing switch 38 and generating an electrical output signal transmitted by lead 40 to the computer indicating that the switch has been actuated.

In operation an operator would, using the handle, move the pointer to a position marked on the panel identifying the operation he wanted to have the washing machine perform such as "Heavy Wash" or "Rinse Only" and then push the handle in to actuate the switch. The computer would when it received the pulse from actuating the switch interpret the voltage signal it was then receiving from the potentiometer to initiate the corresponding one of the programs it had stored for operation of the appliance. From time to time the computer would as appropriate move the pointer to point to messages on the panel such as "Now Rinsing" or "Done" which would inform the operator of the state of the operation.

What is claimed is:

1. A signaling machine providing intercommunication between an operator and a computer controlling operations of an appliance, comprising a housing with means for affixing said housing to a control panel of an appliance, a pointer supported on said housing and movable with respect to said housing so as to provide to an operator a visible signal of its position, a handle coupled to said pointer whereby an operator can move said pointer, a motor with connections to receive input signals from said computer and coupled to said pointer to move said pointer in response to said input signals, a signal generator coupled to said pointer and constructed and connected to send a signal to said computer indicative of the position of said pointer, wherein said motor is coupled to said pointer through a clutch.

2. A signaling machine providing intercommunication between an operator and a computer controlling operations of an appliance, comprising a housing with means for affixing said housing to a control panel of an appliances, a pointer supported on said housing and movable with respect to said housing so as to provide to an operator a visible signal of its position, a handle coupled to said pointer whereby an operator can move said pointer, a motor with connections to receive input signals from said computer and coupled to said pointer to move said pointer in response to said input signals, a signal generator coupled to said pointer and constructed and connected to send a signal to said computer indicative of the position of said pointer, and a switch with an actuator operable by an operator said switch being connected to emit an output signal indicating that an operator has actuated the switch, wherein said pointer and said actuator are coupled to a shaft, rotation of said shaft moving said pointer to different positions and axial motion of said shaft actuating said switch.

* * * * *